US010323459B2

(12) United States Patent
Mauldin

(10) Patent No.: US 10,323,459 B2
(45) Date of Patent: Jun. 18, 2019

(54) BEACH UMBRELLA TOOL

(71) Applicant: Eddie Mauldin, Albemarle, NC (US)

(72) Inventor: Eddie Mauldin, Albemarle, NC (US)

( * ) Notice: Subject to any disclaimer, the term of this patent is extended or adjusted under 35 U.S.C. 154(b) by 0 days.

(21) Appl. No.: 16/117,762

(22) Filed: Aug. 30, 2018

(65) Prior Publication Data

US 2019/0078387 A1 Mar. 14, 2019

Related U.S. Application Data

(60) Provisional application No. 62/556,642, filed on Sep. 11, 2017.

(51) Int. Cl.

| | |
|---|---|
| ***E21B 7/02*** | (2006.01) |
| ***A45B 23/00*** | (2006.01) |
| ***E21B 10/44*** | (2006.01) |
| ***A45B 7/00*** | (2006.01) |
| *A45B 25/00* | (2006.01) |

(52) U.S. Cl.

CPC ..... *E21B 7/027* (2013.01); *A45B 7/00* (2013.01); *A45B 7/005* (2013.01); *A45B 23/00* (2013.01); *E21B 7/028* (2013.01); *E21B 10/44* (2013.01); *A45B 2025/003* (2013.01)

(58) Field of Classification Search

CPC ..... E21B 7/027; E21B 7/028; E21B 10/44; A45B 7/00; A45B 7/005

See application file for complete search history.

(56) References Cited

U.S. PATENT DOCUMENTS

| | | | | |
|---|---|---|---|---|
| 3,160,210 | A * | 12/1964 | Brewer | E21B 37/00 137/268 |
| 5,156,369 | A * | 10/1992 | Tizzoni | E04H 12/2223 135/16 |
| 5,396,916 | A * | 3/1995 | Boissonnault | A45B 7/005 135/16 |
| 5,454,435 | A * | 10/1995 | Reinhardt | E21B 11/005 175/19 |
| 6,076,617 | A * | 6/2000 | Berner | E21B 7/005 175/18 |
| 9,556,692 | B1 * | 1/2017 | Cordova | E21B 21/16 |
| 2018/0290032 | A1 * | 10/2018 | Solheim | A63B 60/14 |

* cited by examiner

*Primary Examiner* — David J Bagnell
*Assistant Examiner* — Tara E Schimpf

(57) ABSTRACT

The beach umbrella tool comprises a T-shaped armature with an auger blade surrounding the bottom portion of a vertical main armature. A bearing at the top of the main armature may be held with one hand while the other hand is used to move a handle located at the end of a horizontal armature in circular motion. The resulting rotation of the T-shaped armature causes the auger blade to rotate and thereby remove sand from the beach beneath the beach umbrella tool. The bottom of a beach umbrella may be placed into the resulting hole.

13 Claims, 4 Drawing Sheets

BEACH UMBRELLA TOOL

CROSS REFERENCES TO RELATED APPLICATIONS

This application claims the benefit of U.S. Provisional Application No. 62/556,642, filed Sep. 11, 2017.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of recreational equipment, more specifically, a beach umbrella tool.

SUMMARY OF INVENTION

The beach umbrella tool comprises a T-shaped armature with an auger blade surrounding the bottom portion of a vertical main armature. A bearing at the top of the main armature may be held with one hand while the other hand is used to move a handle located at the end of a top, horizontal crossbar in a circular motion. The resulting rotation of the T-shaped armature causes the auger blade to rotate and thereby remove sand from the beach beneath the beach umbrella tool. The bottom of a beach umbrella may be placed into the resulting hole.

An object of the invention is to remove sand from a beach to produce a hole for the placement of a beach umbrella.

Another object of the invention is to provide a bearing on the main armature for easier cranking of the tool.

A further object of the invention is to provide a rotating handle on the top crossbar for easier cranking of the tool.

These together with additional objects, features and advantages of the beach umbrella tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the beach umbrella tool in detail, it is to be understood that the beach umbrella tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the beach umbrella tool.

It is therefore important that the claims be regarded as including such equivalent construction insofar as they do not depart from the spirit and scope of the beach umbrella tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
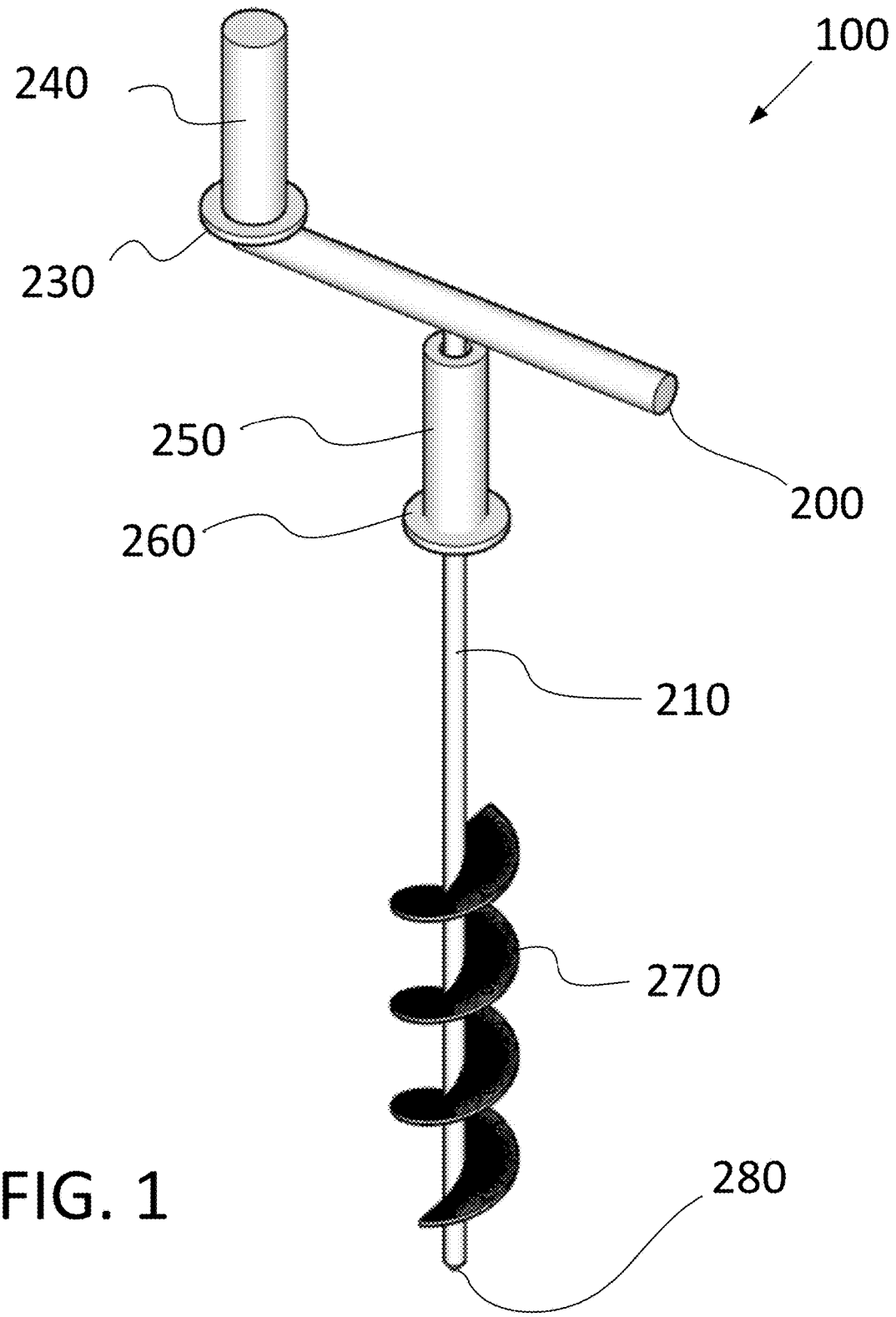
FIG. 1 is a perspective view of an embodiment of the disclosure.
Figure 2:
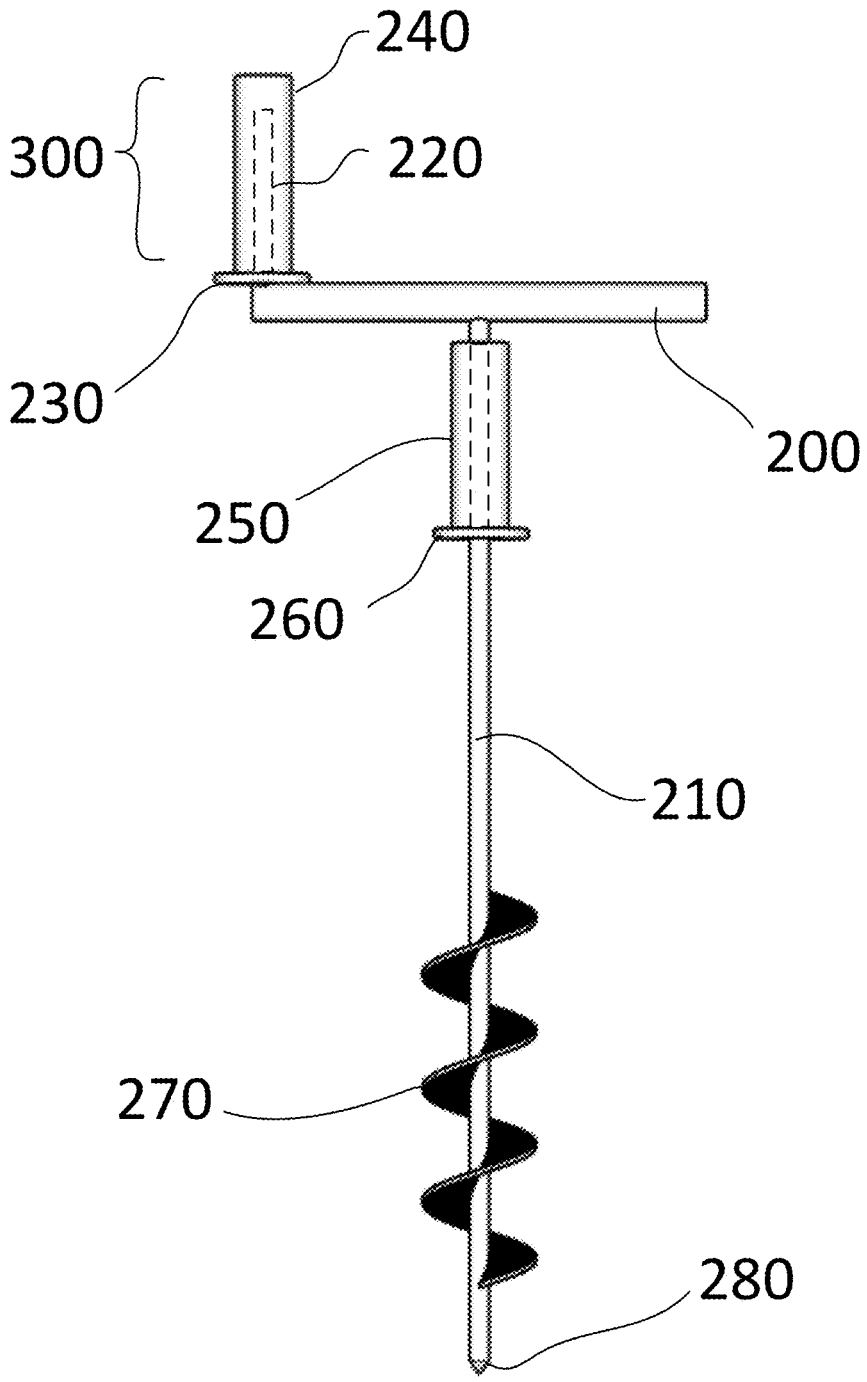
FIG. 2 is a front view of an embodiment of the disclosure.
Figure 3:
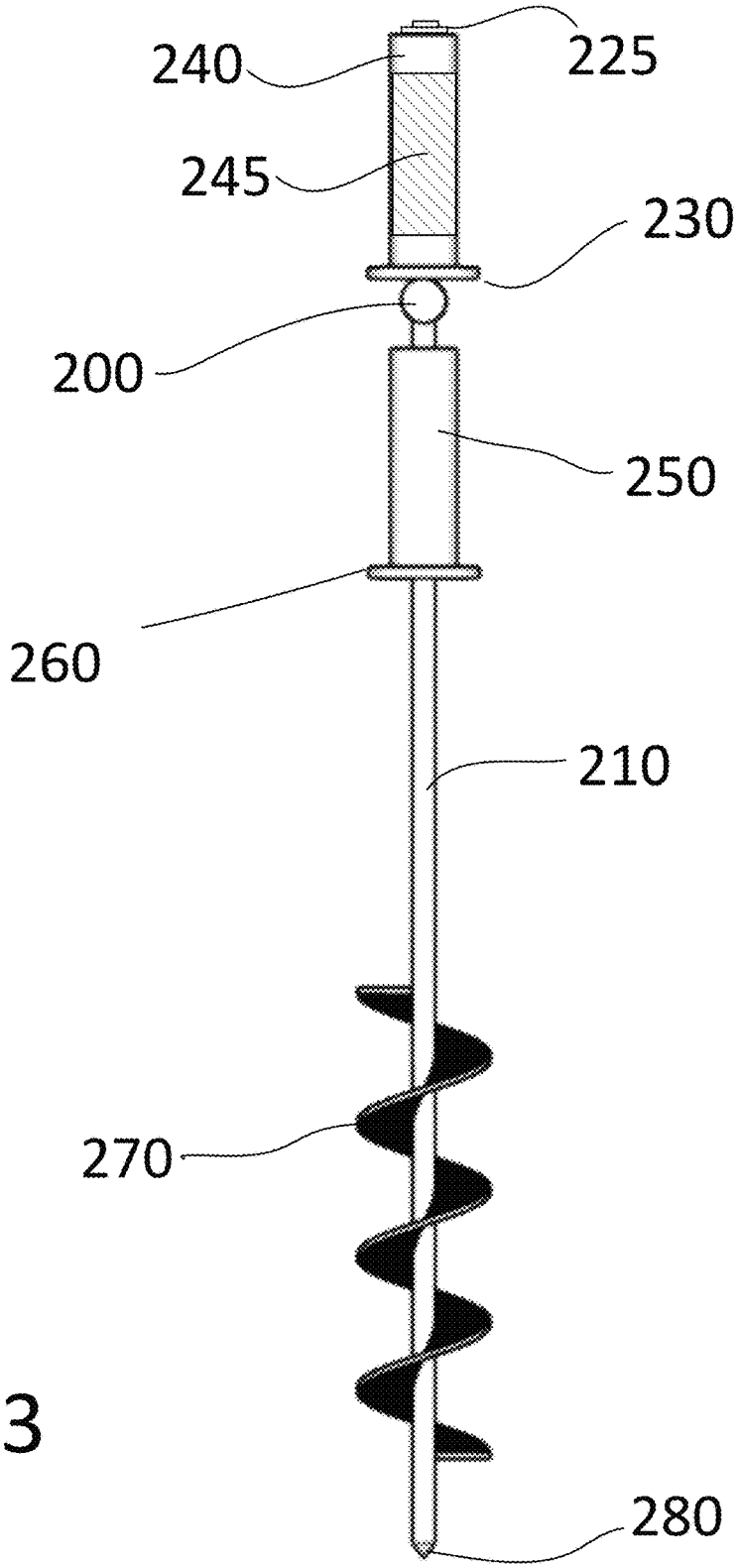
FIG. 3 is a side view of an embodiment of the disclosure.
Figure 4:
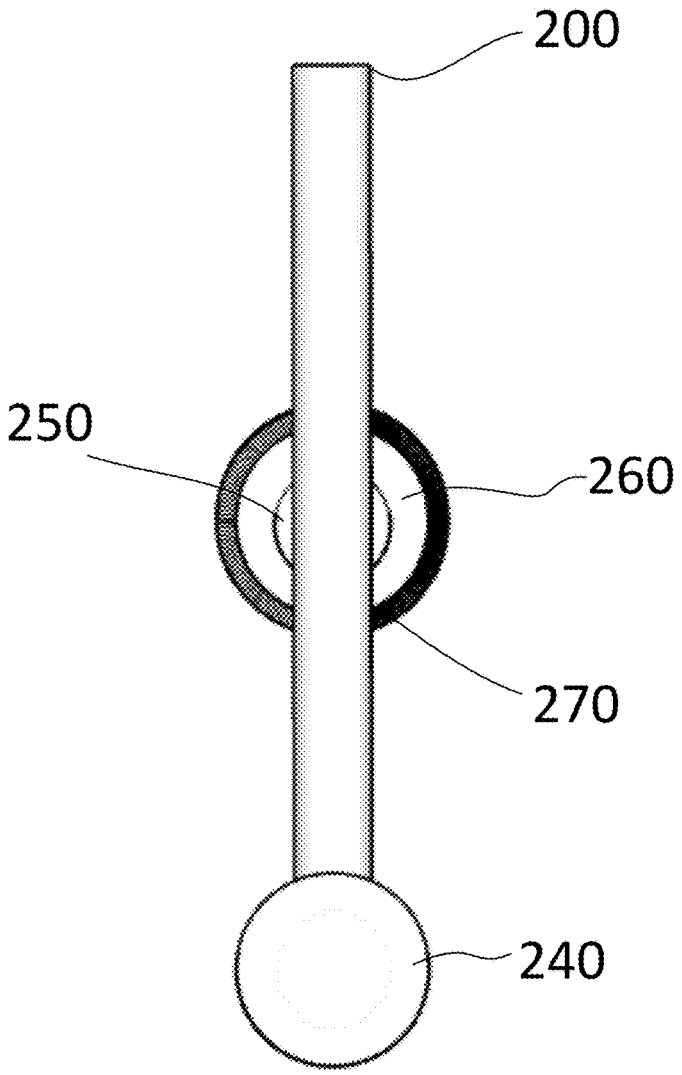
FIG. 4 is a top view of an embodiment of the disclosure.

Detailed reference will now be made to a first potential embodiment of the disclosure, which is illustrated in FIGS. 1 through 4.

The beach umbrella tool 100 (hereinafter invention) comprises a crossbar 200, a main shaft 210, a bearing 250, a bearing stop 260, a handle 300, and an auger blade 270. The invention 100 may be used to drill a hole in sand at a beach in preparation for placing a beach umbrella. The invention 100 is held upright using the bearing 250 with a tip 280 placed on the sand. As the invention 100 is cranked by moving the handle 300 in a circular motion, the auger blade 270 digs into the sand and lifts the sand to create the hole.

The crossbar 200 may be a horizontal armature and the main shaft 210 may be a vertical armature. The upper end of the main shaft 210 may couple to the center of the crossbar 200 to form a 'T' shaped crank.

The bearing 250 may be a hollow cylinder that surrounds the main shaft 210. The bearing 250 may be supported at a specific height on the main shaft 210 by the bearing stop 260. The bearing stop 260 may be an annular disk that surrounds the main shaft 210 and is coupled to the main shaft 210 in an orientation where the longitudinal axis of the main shaft 210 is perpendicular to the plane of the bearing stop 260. The distance from the crossbar 200 to the top surface of the bearing stop 260 is at least as large as the height of the bearing 250.

The handle 300 comprises a handle shaft 220, a handle guard 230, and a handle grip 240. The handle 300 may couple to an end of the crossbar 200. Specifically, the handle shaft 220 may couple to an end of the crossbar 200 in an orientation where it is perpendicular to the crossbar 200 and extends upwards from the crossbar 200. The handle guard 230 may be an annular disk that surrounds the handle shaft 220 at the bottom of the handle shaft 220. The handle guard 230 may be coupled to the handle shaft 220 in an orientation where the plane of the handle guard 230 is parallel to the plane of the bearing stop 260. The handle guard 230 may prevent a user's hand (not illustrated in the figures) from being struck by the crossbar 200 as the invention 100 is cranked.

The handle grip 240 may be a hollow cylinder that is placed over the handle shaft 220. The handle grip 240 may be free to rotate around the handle shaft 220 and may rest on the handle guard 230 as it rotates. The upper end of the handle grip 240 may be closed off and the handle grip 240 may include external contours 245 that make it more comfortable to hold. In some embodiments, the handle grip 240 may be removable from the invention 100 when the invention 100 is not in use.

The bottom of the main shaft 210 may be surrounded by and coupled to the auger blade 270. The auger blade 270 may be a helical screw blade that acts as an inclined plane and forces the sand up the auger blade 270 as the main shaft 210 is rotated. Once the auger blade 270 has moved the sand to a height that is above the level of the beach, the lack of sides on the auger blade 270 may allow the sand to fall off of the auger blade 270 and onto the beach next to the hole. The movement of the sand creates the hole into which the bottom of the beach umbrella may be inserted.

In some embodiments, the bottom of the main shaft 210 may be tapered or narrowed in at least one direction to form the tip 280.

In some embodiments, the crossbar 200 and the main shaft 210 may meet to form an 'L'-shaped crank. In these embodiments, the crossbar 200 may be shorter than shown in FIG. 1 so that it does not extend horizontally past the main shaft 210 on the side opposite the handle 300.

In some embodiments, the handle grip 240 may be retained by the handle shaft 220. As a non-limiting example, the top of the handle shaft 220 may pass through an upper portion of the handle grip 240 and a clip 225 may retain the handle grip 240 onto the handle shaft 220.

Unless otherwise stated, the words "up", "down", "top", "bottom", "upper", and "lower" should be interpreted within a gravitational framework, "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a shaft is the top end.

As used in this disclosure, an "auger" is a tool with a helical or screw type bit that may be used for boring holes in objects. Augers may also be used to move material through a linear distance.

As used in this disclosure, a "bearing" is anything that holds a rotating or sliding shaft. A bearing may guide the motion of a component, limit the motion of a moving component relative to a fixed component and/or reduce the friction between the moving component and the fixed component.

As used in this disclosure, a "blade" is a term that is used to describe a wide and flat structure, or portion of a larger structure such as a propeller, or the cutting edge of a tool.

As used in this disclosure, a "clip" is a fastener that attaches to an object by gripping or clasping the object. A clip is typically spring loaded.

As used herein, the words "couple", "couples", "coupled" or "coupling", mean connected, either directly or indirectly and does not necessarily imply a mechanical connection.

As used in this disclosure, a "crank" is a handle or an arm that is attached perpendicularly to the axis of rotation of a shaft and that is used for transmitting rotary motion to the shaft.

As used in this disclosure, a "cylinder" is a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

As used in this disclosure, a "disk" is a cylindrically shaped object that is flat in appearance.

As used in this disclosure, a "grip" is a covering that is placed over a hand hold, handle, or shaft.

As used in this disclosure, a "handle" is an object by which a tool, object, or door is held or manipulated with the hand.

As used in this disclosure, "horizontal" is a directional term that refers to a direction that is perpendicular to the local force of gravity. Unless specifically noted in this disclosure, the horizontal direction is always perpendicular to the vertical direction.

As used herein, the word "longitudinal" refers to a lengthwise direction.

As used in this disclosure, "orientation" refers to the positioning and/or angular alignment of a first object relative to a second object or relative to a fixed position, location, or direction.

As used in this disclosure, the term "shaft" is used to describe a rigid cylinder that is often used as the handle of a tool or implement. The definition of shaft explicitly includes solid shafts or shafts that comprise a hollow passage through the shaft along the center axis of the shaft cylinder, whether the shaft has one or more sealed ends or not.

As used in this disclosure, a "tool" is a device, an apparatus, or an instrument that is used to carry out an activity, operation, or procedure.

As used in this disclosure, an "umbrella" is a device used for protection against the weather, including rain, sun, and snow, comprising a canopy made of a textile or sheeting that is mounted on a folding metal frame and is supported by a central rod.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A beach umbrella tool comprising:

a crossbar, a main shaft, a bearing, a bearing stop, a handle, and an auger blade;

wherein the beach umbrella tool is used to drill a hole in sand at a beach in preparation for placing a beach umbrella;

wherein the beach umbrella tool is adapted to be held upright by a user's hand using the bearing with a tip placed on the sand;

wherein the auger blade digs into the sand and lifts the sand to create the hole as the beach umbrella tool is cranked by moving the handle in a circular motion;

wherein the crossbar is a horizontal armature;

wherein the main shaft is a vertical armature;

wherein the upper end of the main shaft couples to the center of the crossbar to form a 'T' shaped crank;

wherein the bearing is a hollow cylinder that surrounds the main shaft;

wherein the bearing is supported at a specific height on the main shaft by the bearing stop;

wherein the bearing stop is an annular disk that surrounds the main shaft and is coupled to the main shaft in an orientation where the longitudinal axis of the main shaft is perpendicular to the plane of the bearing stop;

wherein the distance from the crossbar to the top surface of the bearing stop is at least as large as the height of the bearing.

2. The beach umbrella tool according to claim 1 wherein the handle comprises a handle shaft, a handle guard, and a handle grip;

wherein the handle couples to an end of the crossbar.

3. The beach umbrella tool according to claim 2 wherein the handle shaft couples to the end of the crossbar in an orientation where it is perpendicular to the crossbar and extends upwards from the crossbar.

4. The beach umbrella tool according to claim 3 wherein the handle guard is adapted to prevent a user's other hand from being struck by the crossbar as the beach umbrella tool is cranked;

wherein the handle guard is an annular disk that surrounds the handle shaft at the bottom of the handle shaft.

5. The beach umbrella tool according to claim 4 wherein the handle guard is coupled to the handle shaft in an orientation where the plane of the handle guard is parallel to the plane of the bearing stop.

6. The beach umbrella tool according to claim 5 wherein the handle grip is a hollow cylinder that is placed over the handle shaft;

wherein the handle grip is free to rotate around the handle shaft and rests on the handle guard as it rotates.

7. The beach umbrella tool according to claim 6 wherein the upper end of the handle grip is closed off;

wherein the handle grip includes external contours that make it more comfortable to hold.

8. The beach umbrella tool according to claim 6 wherein the handle grip is removable from the beach umbrella tool when the beach umbrella tool is not in use.

9. The beach umbrella tool according to claim 6 wherein the bottom of the main shaft is surrounded by and coupled to the auger blade.

10. The beach umbrella tool according to claim 9 wherein the auger blade is a helical screw blade that acts as an inclined plane and forces the sand up the auger blade as the main shaft is rotated;

wherein once the auger blade has moved the sand to a height that is above the level of the beach, the lack of sides on the auger blade allows the sand to fall off of the auger blade and onto the beach next to the hole;

wherein the movement of the sand creates the hole into which the bottom of the beach umbrella is inserted.

11. The beach umbrella tool according to claim 10 wherein the bottom of the main shaft is narrowed in at least one direction to form the tip.

12. The beach umbrella tool according to claim 10 wherein the handle grip is retained by the handle shaft.

13. The beach umbrella tool according to claim 12 wherein the top of the handle shaft passes through an upper portion of the handle grip and a clip retains the handle grip onto the handle shaft.

* * * * *